US010538296B2

(12) United States Patent
Duff

(10) Patent No.: US 10,538,296 B2
(45) Date of Patent: Jan. 21, 2020

(54) AQUATIC BOARD SADDLE

(71) Applicant: ZUP LLC, Williamsburg, VA (US)

(72) Inventor: Glen Wade Duff, Virginia Beach, VA (US)

(73) Assignee: ZUP LLC, Williamsburg, VA (US)

( * ) Notice: Subject to any disclaimer, the term of this patent is extended or adjusted under 35 U.S.C. 154(b) by 0 days.

(21) Appl. No.: 16/008,607

(22) Filed: Jun. 14, 2018

(65) Prior Publication Data

US 2018/0362122 A1 Dec. 20, 2018

Related U.S. Application Data

(60) Provisional application No. 62/519,679, filed on Jun. 14, 2017.

(51) Int. Cl.

| | |
|---|---|
| ***B63B 35/85*** | (2006.01) |
| ***B63B 35/79*** | (2006.01) |
| *B63B 35/71* | (2006.01) |

(52) U.S. Cl.

CPC ..... *B63B 35/7936* (2013.01); *B63B 35/85* (2013.01); *B63B 2035/715* (2013.01)

(58) Field of Classification Search

CPC .. B63B 35/7936; B63B 35/7933; B63B 35/85
See application file for complete search history.

(56) References Cited

U.S. PATENT DOCUMENTS

| | | | | |
|---|---|---|---|---|
| 4,194,458 A * | 3/1980 | Messing | B63B 35/7943 114/363 |
| 5,224,891 A * | 7/1993 | Stephens | A47C 15/006 114/363 |
| 2010/0105263 A1* | 4/2010 | Churchill | B63B 35/74 441/72 |
| 2015/0059637 A1* | 3/2015 | Johns | B63B 35/71 114/363 |
| 2018/0178887 A1* | 6/2018 | Pacini | B63B 35/85 |

* cited by examiner

*Primary Examiner* — Stephen P Avila
(74) *Attorney, Agent, or Firm* — Berenato & White, LLC

(57) ABSTRACT

A saddle for an aquatic board is disclosed. The saddle is equipped with a strap or straps and/or edge wise clamps, or other suitably firm fastener, to engage and maintain position on the aquatic board positioned beneath the saddle. A user can then stand on the board and squeeze the saddle between their knees and ankles and maintain an enhanced balance on the board or, if fatigued, can sit or kneel alongside or on the saddle and paddle/ride from a seated or kneeling position. The saddle may be inflatable or solid and may include an inner void for storage for personal effects or equipment. The saddle may further include a speaker, cup holder, handles, or other optional features.

10 Claims, 11 Drawing Sheets

AQUATIC BOARD SADDLE

This application claims the benefit of prior filed U.S. Provisional Application Ser. No. 62/519,679, filed Jun. 14, 2017, the contents of which are incorporated herein.

FIELD OF THE INVENTION

The invention relates to the field of individual flat board type watercraft used for pleasure. Specifically, the invention is directed to a saddle apparatus for use in combination with a watercraft that has a substantially flat top surface for a rider to otherwise engage. The present invention provides an episodic or continuous use seat/support for a user to engage and better use the watercraft regardless of user dexterity or physical capacity.

BACKGROUND OF THE INVENTION

The stand-up paddle board has been in use for many years. It came from the field of surfing wherein, essentially, a surfboard for use in riding incoming shore directed waves in a fairly high seas condition, i.e., waves exceeding 2-3 feet, could be put to use in a slack water setting. A user could stand upright on the board top surface and while standing on that surface, using a single spade end canoe style paddle, engage the water alongside the board and propel the user in a given selected direction. Inasmuch as the user has to stand on the top surface of a board, which has little in the way of lateral stability, the user of such a device had to have a certain capacity or dexterity to balance. In the same way as windsurfers had to learn to remain upright while hauling up a sail, a standup paddle board user had to negotiate the board's inherent instability, not falling off, get into position astride the board and then, again without falling, engage the water with the paddle and propel the board. Balance dexterity is a necessity to use the board in this way.

In addition to balance, the use of a long paddle from an upright position to engage a surface below one's feet for propulsion requires considerable core strength from that individual. The upright posture and long paddle requires a stiff form from the feet through the shoulders and then strength to propel, balance, and propel again through repeated strokes. In addition, the user has to be adept at changing stroke sides as direction and water conditions warrant. An all-around full-body work-out for a person using the board is unavoidable.

Despite the relative difficulty in using a standup paddle board, it has gained popularity. The board is not bulky, like a surf ski or surf canoe, and can be strapped to a vehicle roof easily and in pairs. In addition, as popularity has increased, inflatable models of such boards have become available. None of this popularity has made the standup paddle board easier to use for those without the dexterity or physical strength necessary to use one, however. And, even if a person can learn to use it, developing endurance to go out for more than 15-20 minutes at a stretch takes time and commitment.

In addition to the foregoing, standup paddle boards are often used for rental excursions during slack water days at lakes and at the beach and on slow moving rivers and/or dams. But, at least two issues can affect their use in such circumstances. The first issue is the lack of comprehension on the part of infrequent users of such devices of the need for physical stamina to go onto the water and use the device for any length of time. The second is the change in water conditions. Even small waves or wakes can make users fall off. Both of these situations create unsafe conditions for users and rental entities. Users get stranded and tired and frustrated and need to be retrieved. This requires putting the user in a retrieval craft and then towing the board behind. Not many users can fit which means many round trips for the rental entity and this creates timing and other safety issues as weather further deteriorates and/or daylight wanes.

SUMMARY OF THE INVENTION

The present invention is a saddle, made of solid or inflatable materials, or a combination of both, equipped with straps or edgewise clamps, to engage the upper surface of an otherwise substantially flat and smooth surfaced aquatic board so that a user may, while standing, squeeze the sides of the saddle with their ankles and knees to maintain balance and/or sit on the saddle with their knees beneath or beside them, but not necessarily in a weight bearing position, and paddle from that position as well. The seat may be hollow or solid, may have a weather proof or insulated void inside the saddle for stowing wallet, phone, a drink, lunch, etc.

The saddle is intended for any aquatic board that has a flat upper surface where such a saddle would enhance or ease the user experience. While primarily intended as an aid to using a standup paddle board, the saddle may be used for tow behind wake board type devices, knee boards, surfboards, windsurfers, etc. where balance and strength are a necessity of use and a removeable saddle would make the device easier to use. By making the device easier for more people to use for longer times, more or such type of boards can be used by a larger cross section of people of varying abilities. As to balance: The ability to squeeze knees and ankles onto a centered soft device can enhance balance and confidence in the user. Such a user will fall less often and enjoy the outing more and be less intimidated by a passing wake or wave. In addition, the seat will provide for rest and a different paddle posture; fatigue will be less of a factor as compared with single paddle posture. And, if fatigue does set in, the user can sit and await retrieval and the device can be towed with the user seated on the device as opposed to clambering into the retrieval craft. If users are seated on the boards, the retrieval craft can be linked to end-to-end configured boards, one hooked to the other, which can then be safely and slowly towed in a row toward the dock or beach.

DETAILED DESCRIPTION

Figure 1:
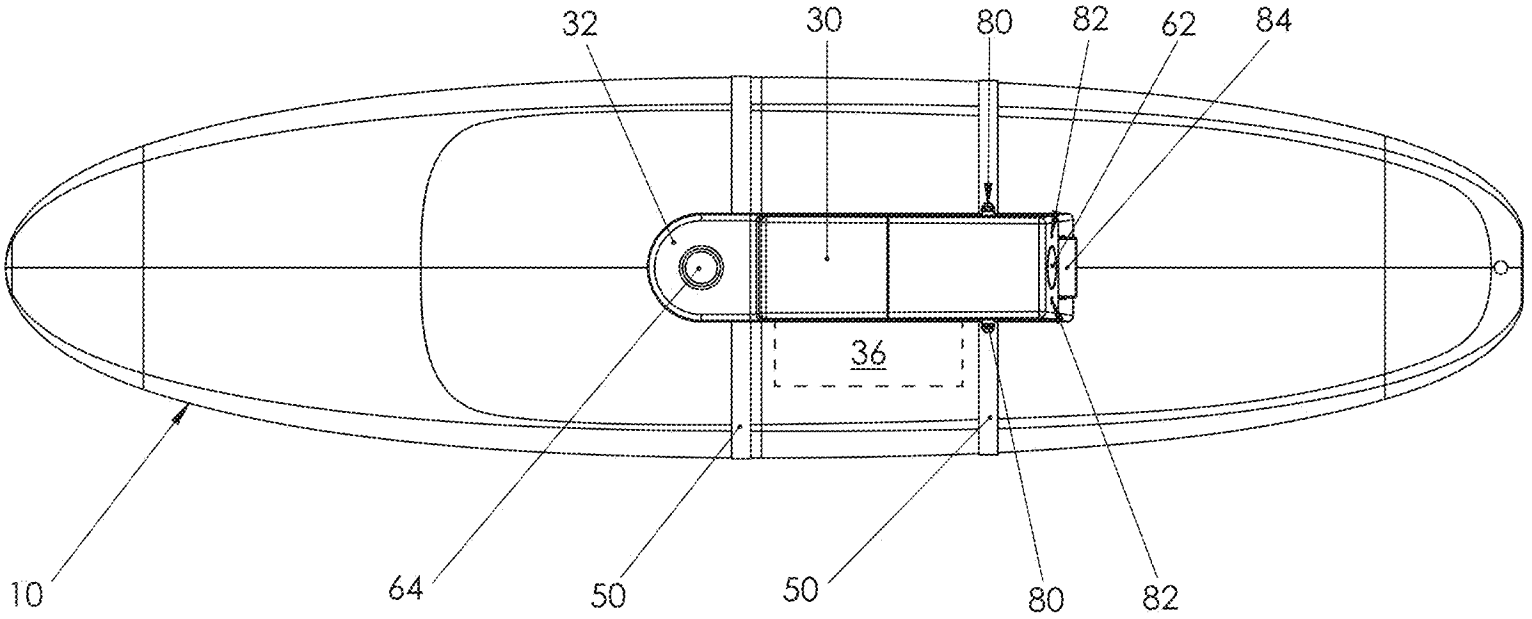
FIG. 1 is a top view of the saddle invention showing it attached to a standup paddle board.
Figure 2:
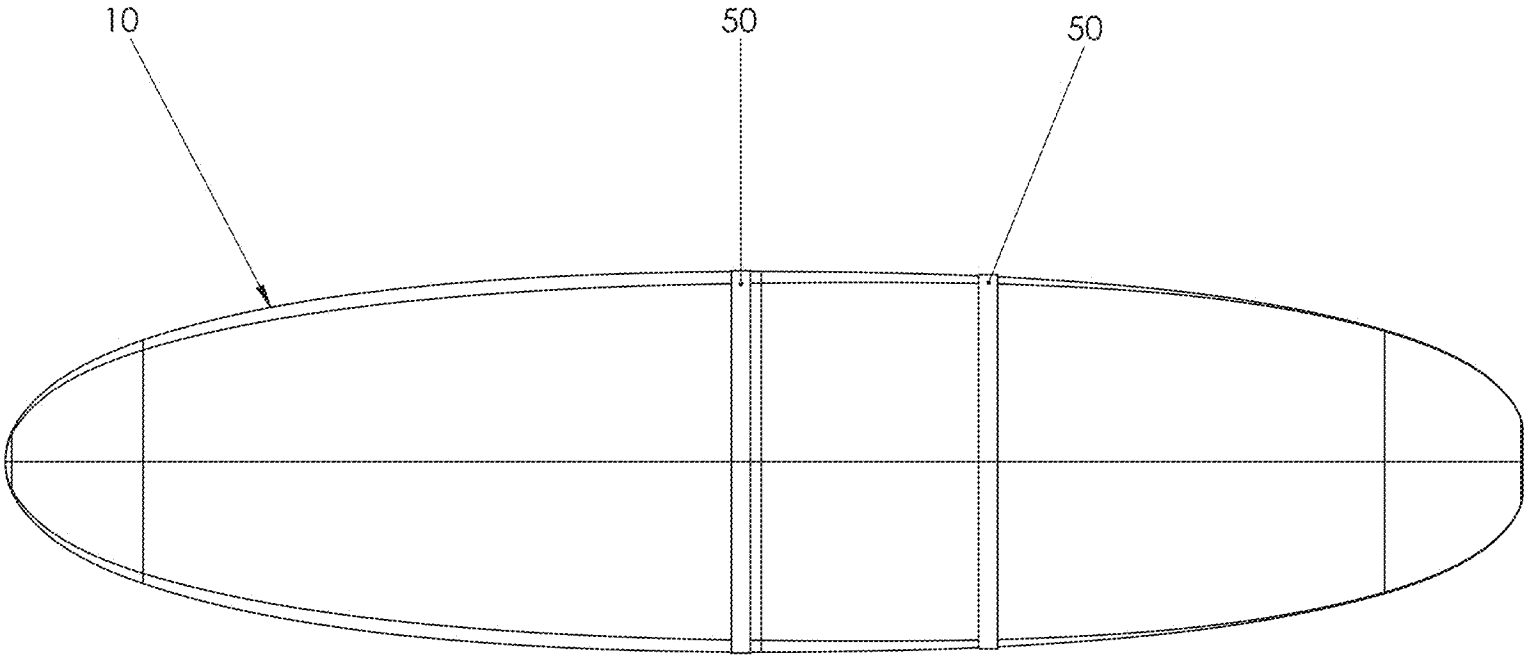
FIG. 2 is a bottom view showing the device of FIG. 1 strapped to the paddle board.
Figure 3:
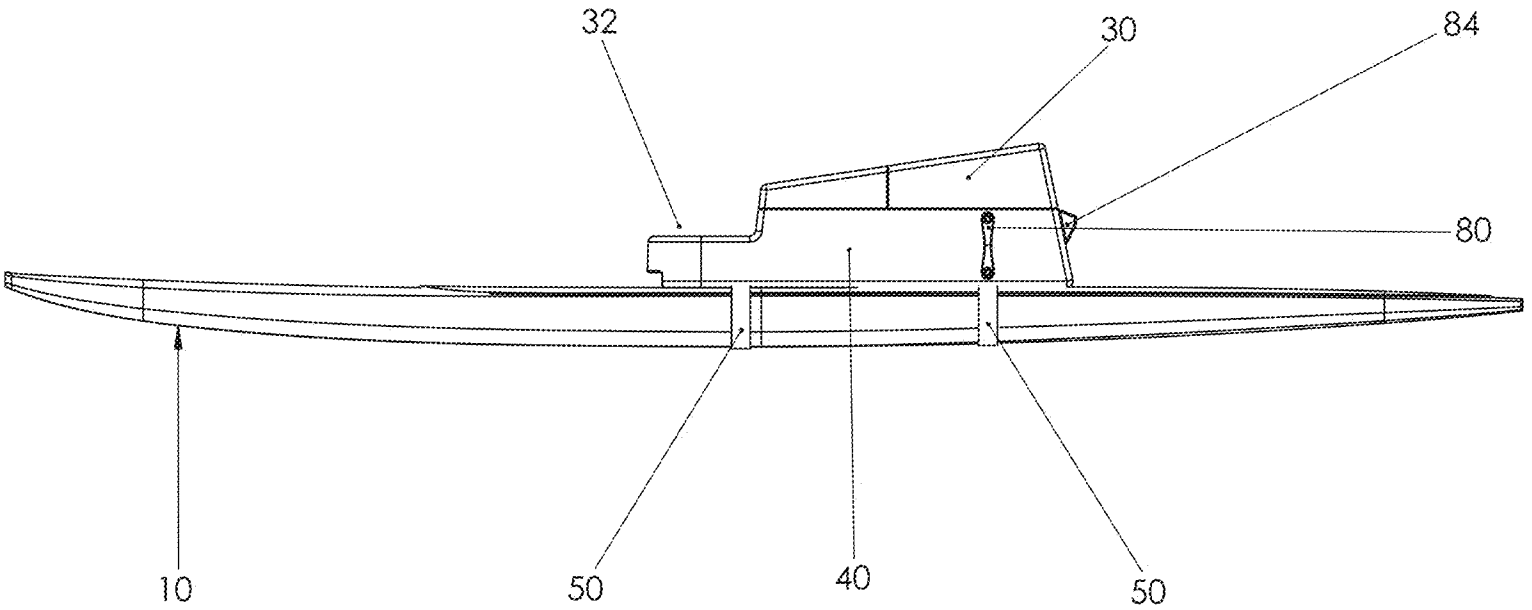
FIG. 3 is a side view of the device as shown in FIG. 1.
Figure 4:
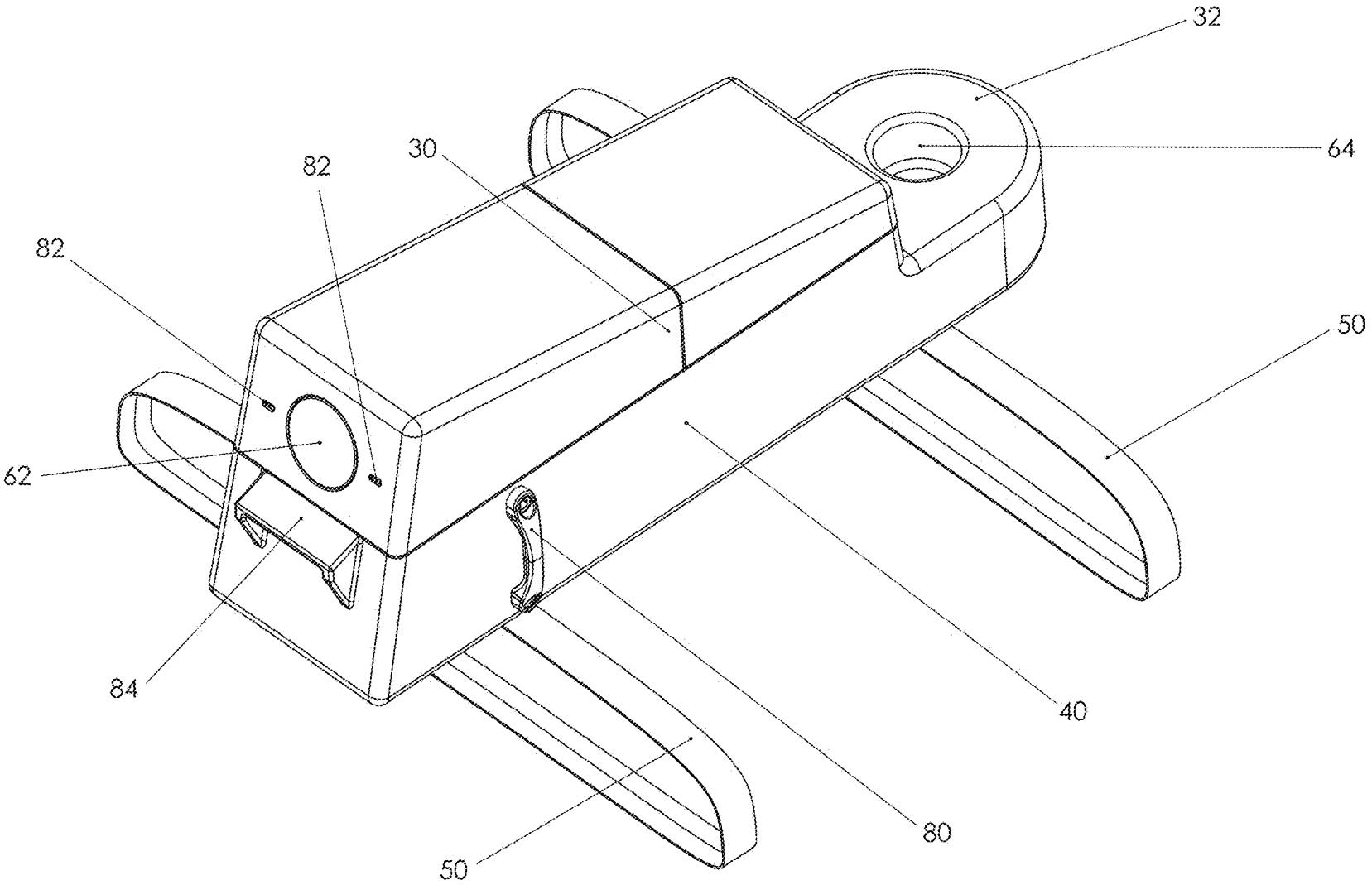
FIG. 4 is an oblique rear view of one embodiment of the invention.

With reference to the drawing figures: The saddle 30 has an upper portion for seating and lower portion 40 for attachment to strap(s) 50 which wrap around a paddle board 10 located beneath the saddle. The saddle may include optional foot locator pads 36 (shown dotted) alongside the saddle on each lateral side to give a user a certain foot location when standing, and may also include a forward cup holder/storage pocket 32 with receptacle 64 for a drink/keys/sunscreen, etc. The seat portion may also be latched (at handle 80) and hinged (forwardly or rearwardly) to lift upwardly and reveal an inner void 100 comprising a water proof and/or insulated compartment. The seat portion may also simply lift off the base 40. Handles 80 may be strategically located along side portions of the saddle 30 for lifting and carrying the saddle alone, or helping to lifting and move the related saddle 30 and board assembly 10. The handles 80 are also useful by a user to haul themselves onto the board when alighting from the water. This embodiment is also shown with a speaker (waterproof, battery activated, with Bluetooth, for example) 62 and a USB connector 82 for a music player or phone, etc.

Figure 9:
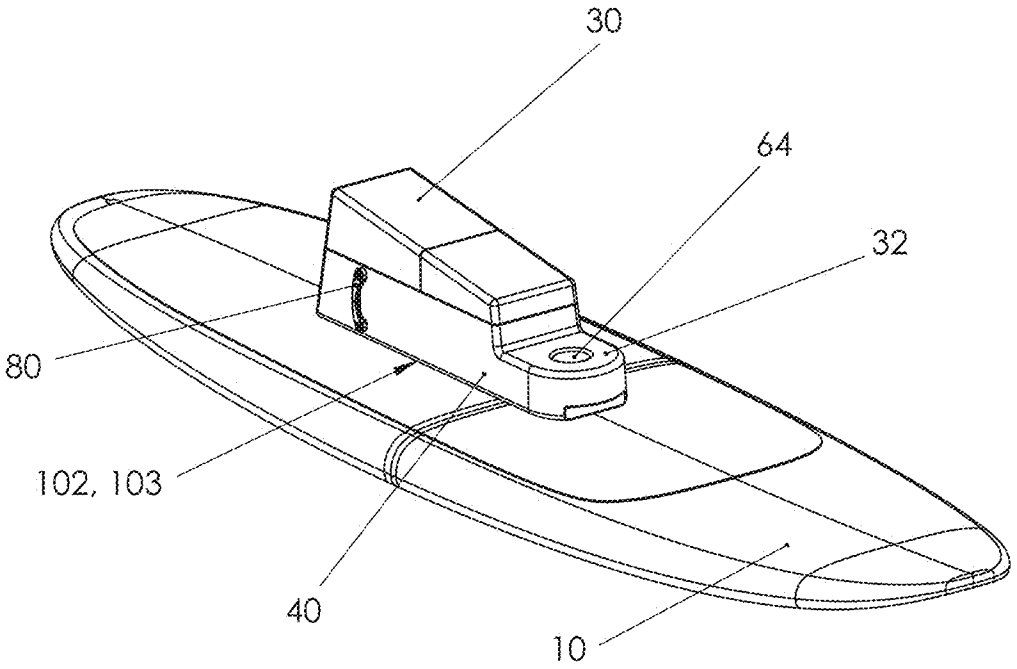
FIG. 9 shows edgewise clamps for attaching any version of the invention to a board located beneath.
Figure 10:
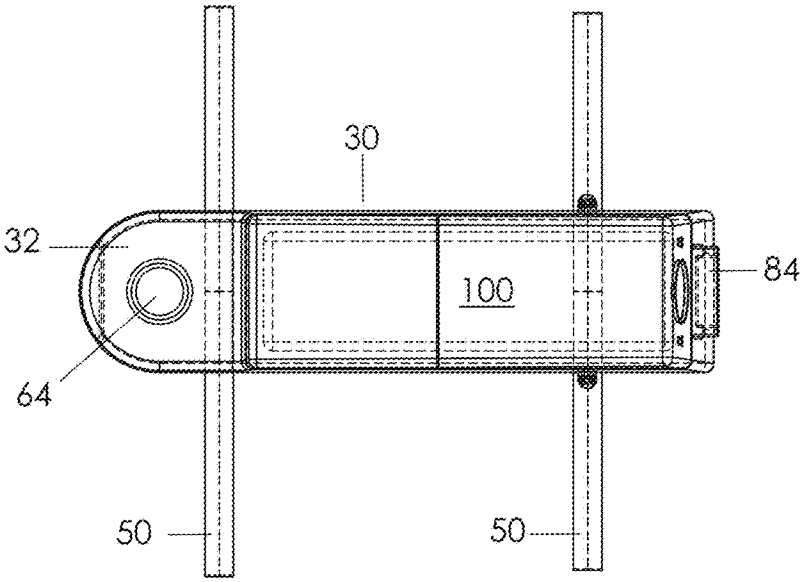
FIG. 10 shows a top view saddle device in accord with the present invention with dotted lines indicating interior compartment.
Figure 11:
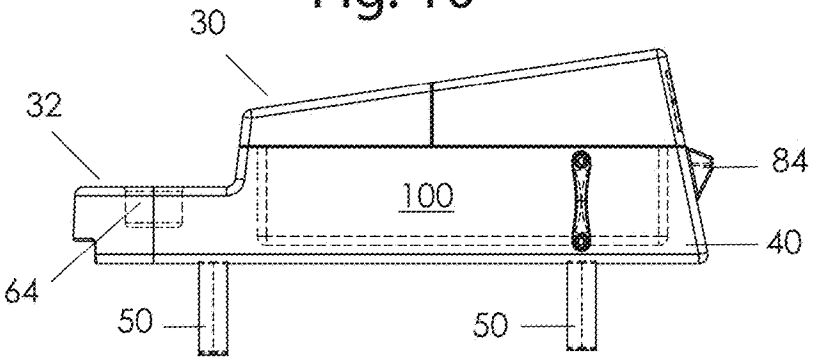
FIG. 11 is a side view of the saddle shown in FIG. 10.
Figure 12:
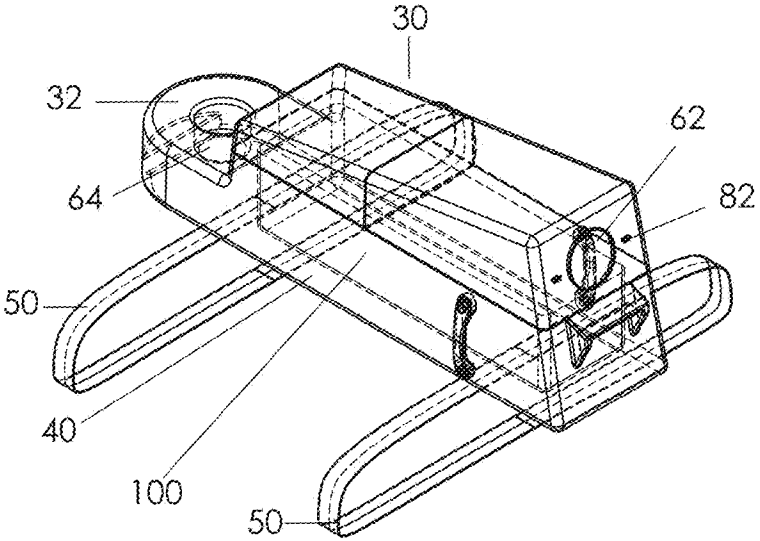
FIG. 12 is an oblique rear view of the device shown in FIG. 10.
Figure 13:
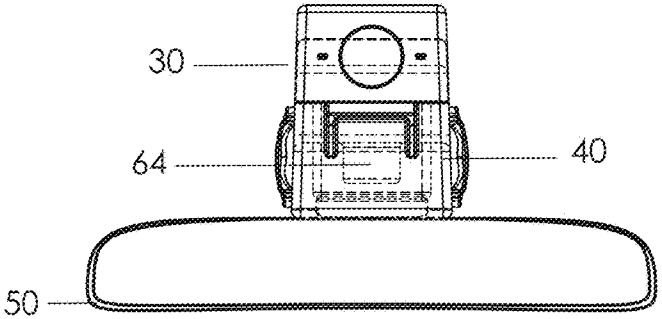
FIG. 13 is a forward view of the device shown in FIG. 10.

The saddle 30 may be made of an inflatable material with gussets and seams to maintain shape, like an inflatable life jacket or air mattress, or can be made of buoyant foam, like a watercraft seat. The respective seat and base portion are made from complementary shapes which nest and fit together and are retained in that position in use. The straps 50 are made of a woven non-stretching product or, alternatively, a relatively resilient bungy style cord, that can be equipped with hook and loop or buckle type or bayonet clip fasteners to relate one end to the other or wrap around the board and attach to an opposing side of the saddle, and firmly locate the saddle 30 atop the aquatic board 10 located beneath. Edgewise clamps 90 (FIG. 9) may also be used to attach the saddle 30 the board 10. The edgewise clamps can be slide related elements designed to clamp at a given length and be tightened using a threaded retainer, ie, bolt and wingnut, or can be, themselves, resilient cord elements with edge hooks to clamp over and retain the board 10 edge. Hook and loop patch fasteners can also be used in lieu of or in addition to straps, to retain the saddle in place atop the board 10. (See FIG. 9).

The forward cup holder 32 can likewise be made from an inflatable shaped form or from a solid buoyant foam. The covering materials should be UV and water resistant to enhance longevity in the water and outdoor environment of intended use. The overall length can be in the range or 18 to 30 inches and the height can be selected according to the user, but in the range of 10-18 inches with a slope from back to front, and the width, ideally with a taper increasing front to back and being 6-8 inches wide.

Figure 5:
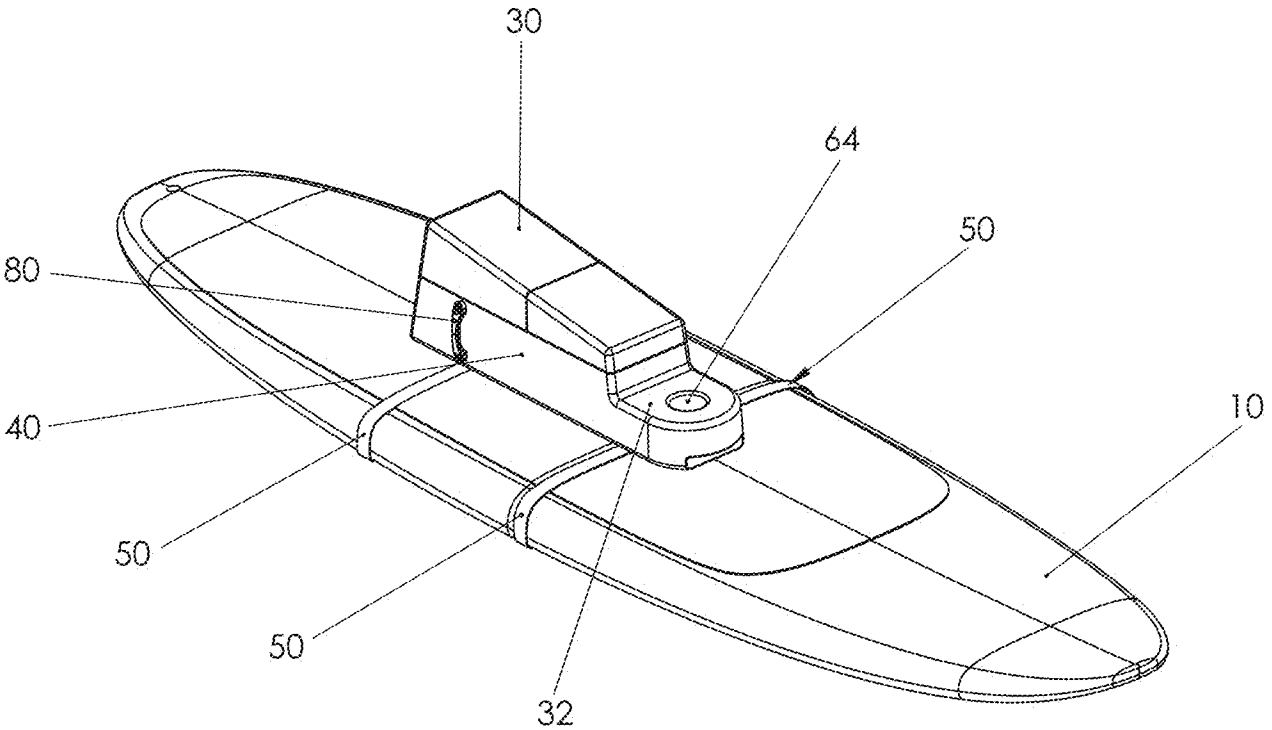
FIG. 5 is an oblique front view of an embodiment of the invention associated with a paddle board.
Figure 6:
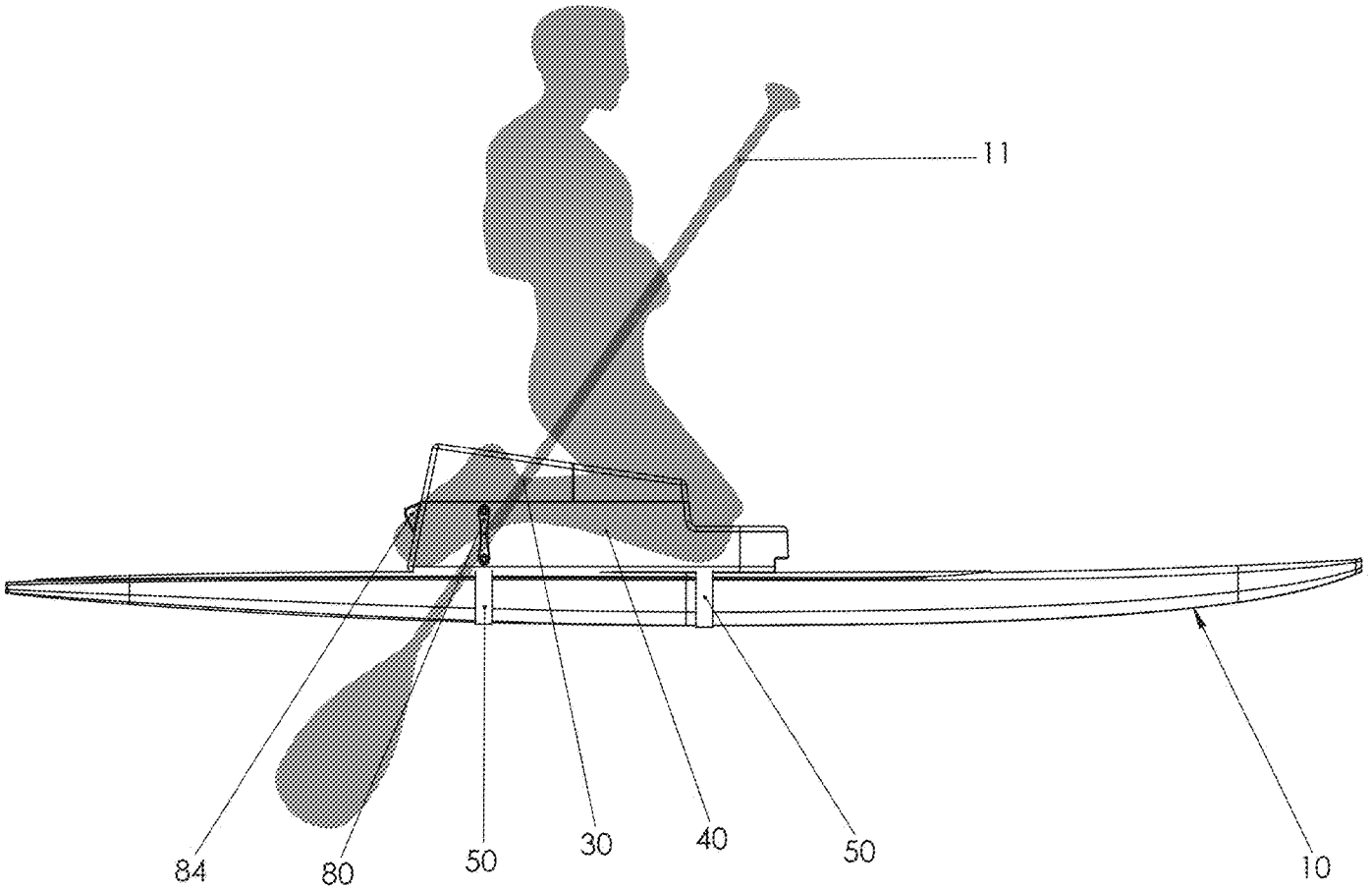
FIG. 6 is a side schematic view of a user in a partially kneeling position using the version of the device shown in FIG. 5.

The embodiment of the saddle shown in FIGS. 5 and 6 is associated with a paddle board. This embodiment is also shown with a speaker (waterproof, battery activated, with Bluetooth, for example) 62 and cup holder 32 with receptacle 64. In use, the embodiment of FIGS. 5 and 6 is adapted for a kneeling posture when seated. This is shown in side view in FIG. 6 with a user manipulating a paddle 11 to create propulsion. When standing, in FIG. 7, a user places their feet alongside the saddle 30 and squeezes the seat/saddle with their feet and ankles and lower leg to retain balance.

Figure 7:
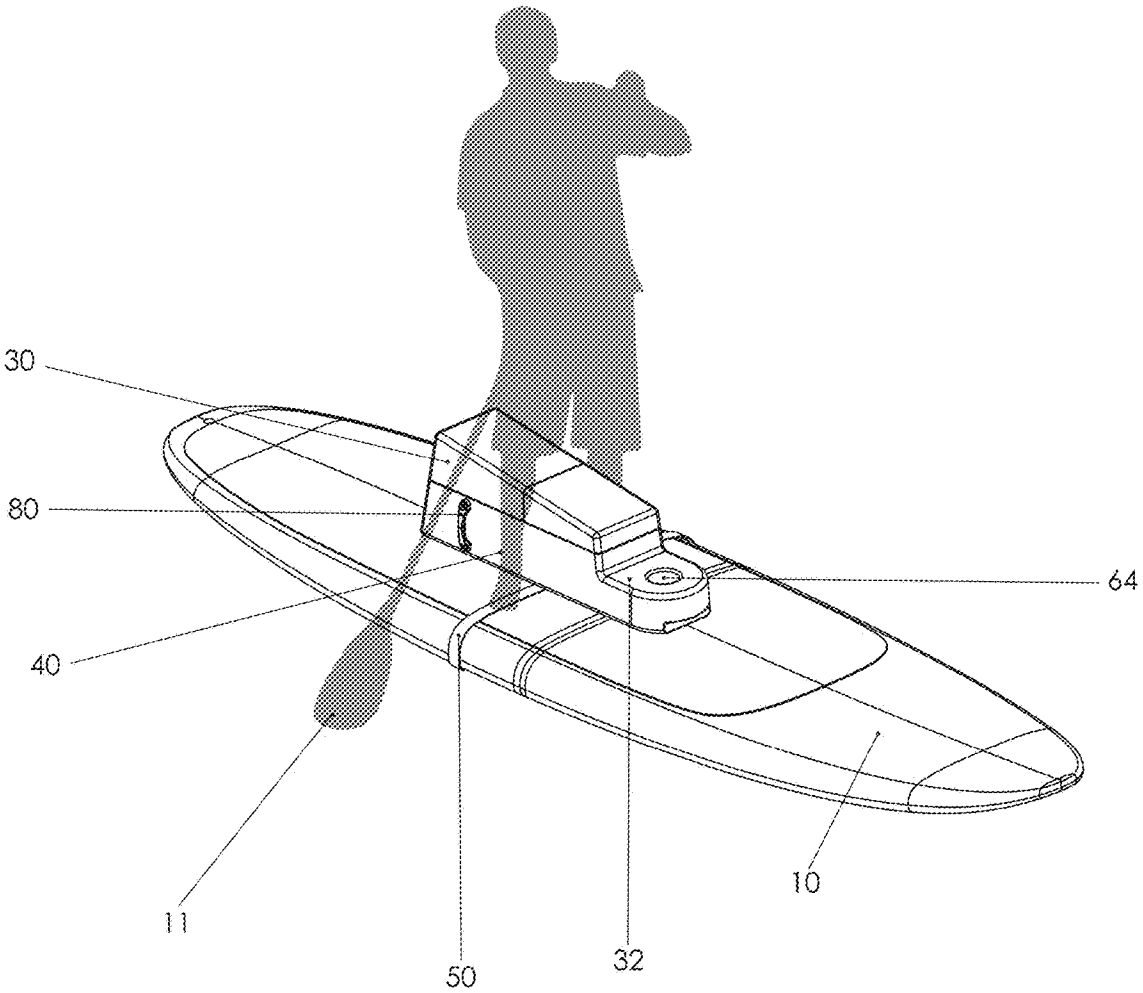
FIG. 7 is an oblique forward view of a single strap alternative embodiment of the invention associated with a paddle board.
Figure 8:
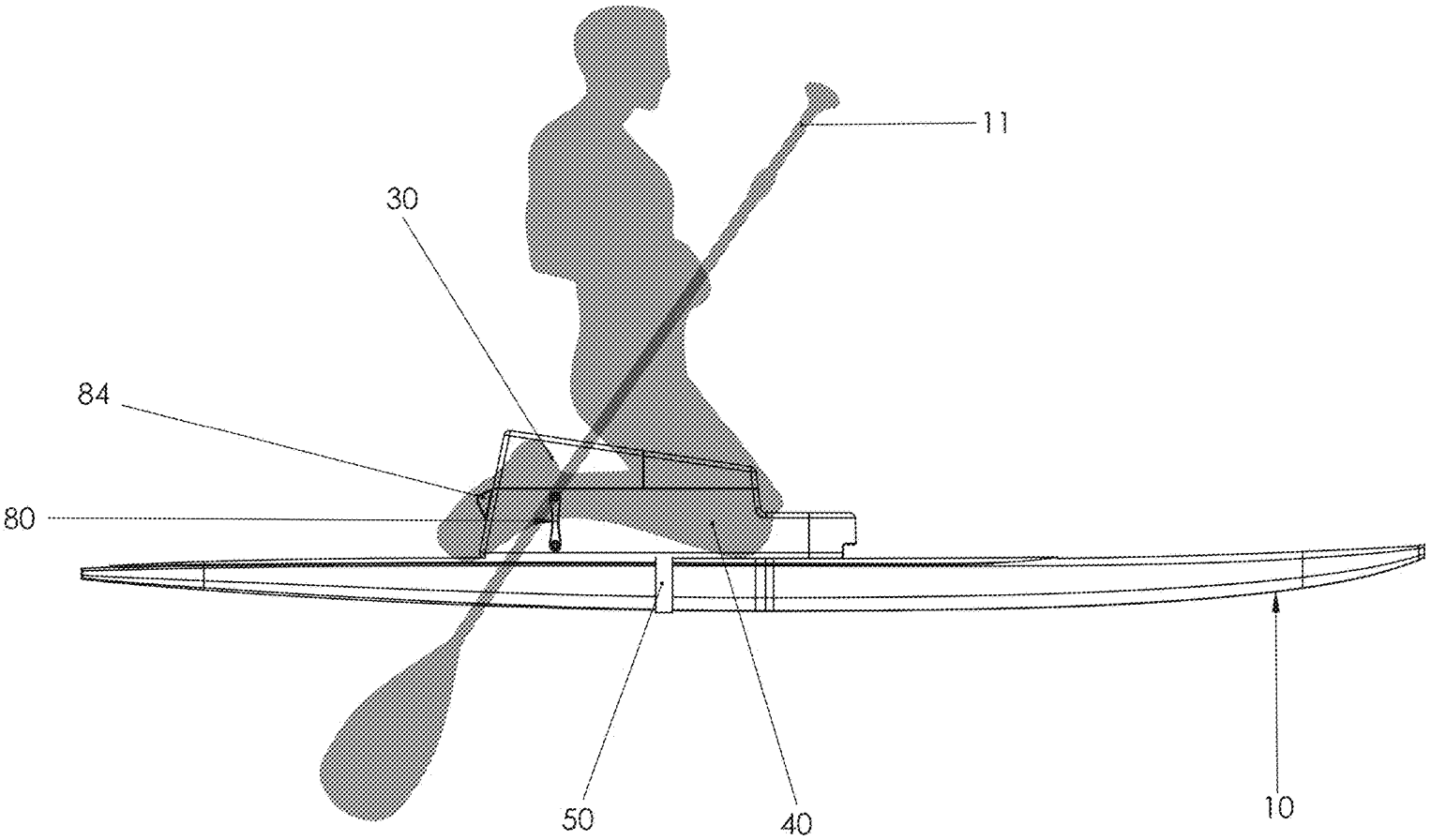
FIG. 8 is a side view schematic of a user riding and using the version shown in FIG. 7.
Figure 14:
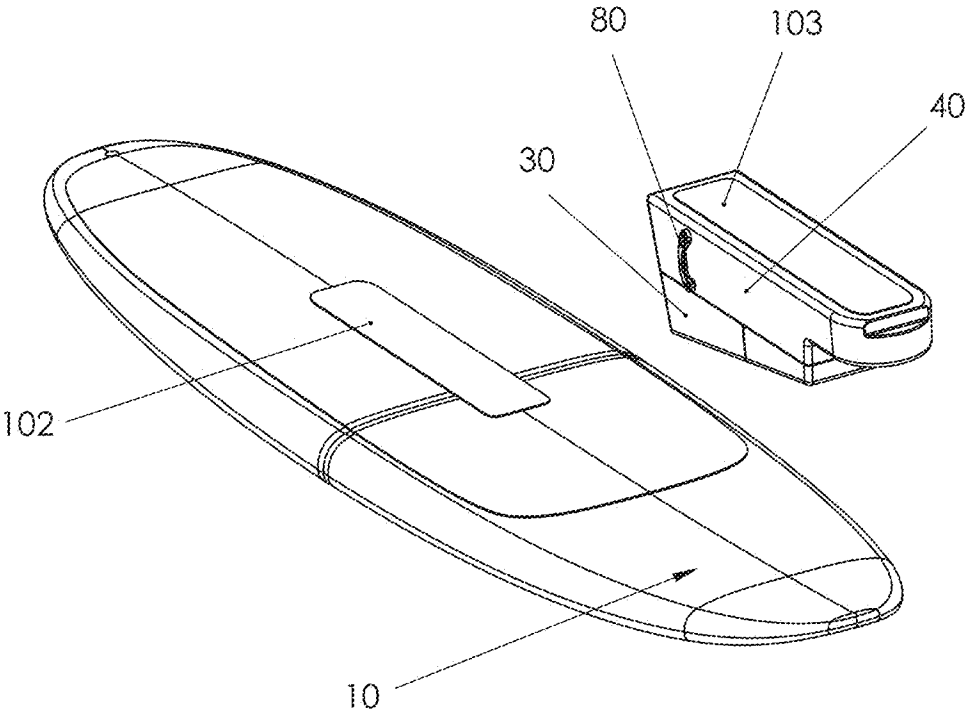
FIG. 14 is an embodiment of the invention showing hook and loop fasteners between the saddle and the underlying board.

The embodiment shown in FIGS. 7 and 8 shows a single strap 50 version of the saddle wherein the user sits on the device 30 seat portion, their knees rest directly on the upper surface of the board 10. The device 30 can also be solid foam or inflatable and is shown with a single strap 50 attaching the device 30 to the board 10. This version of the device is also suitable for smaller aquatic boards, like boogie boards, knee boards, and wake boards, and can be used as a ride-a-long for windsurfers who desire company when they surf. The single strap 50 may be augmented, or replaced altogether, via hook and loop patch fasteners 102, 103 on the respective upper surface of the board 10 and bottom surface(s) of the base portion 40 as shown in FIG. 14.

I claim:

1. A saddle for an aquatic board having an upper surface for user engagement thereon, said saddle comprising:

an upper seat portion sitting atop and associated with a lower base portion, and at least one strap attached to said base portion for attaching said base portion to said upper surface of said board, wherein, said seat portion and lower base portion form a tapered shape increasing from front to back, in a longitudinal orientation along said board, and said seat portion has a slope from back to front, and an overall height, when mounted on said board, of between 10 and 18 inches and an overall width of 6 to 8 inches and a centrally located forward cup holder inset into said lower base portion.

2. A saddle as in claim 1, wherein:

said board is a stand up paddle board.

3. A saddle as in claim 1, wherein:

said board is a windsurfer.

4. A saddle as in claim 1, further comprising:

an internal compartment within said base portion accessible when said seat portion is removed.

5. A saddle as in claim 1, further comprising;

a second strap attached to said base portion for attaching said base portion to said upper surface.

6. A saddle as in claim 1, wherein:

said seat portion and lower base portion are comprised of buoyant foam.

7. A saddle as in claim 1, wherein:

said seat portion and lower base portion are made of inflatable complementary shapes, wherein one nests against and is retained against the other.

8. A saddle as in claim 1, further comprising an integrated speaker.

9. A saddle for an aquatic board having an upper surface for user engagement thereon, said saddle comprising:

an upper seat portion sitting atop and associated with a lower base portion, and at least one fastener means attached to said base portion for attaching said base portion to said upper surface of said board, wherein, said upper seat portion and lower base portion form a tapered shape increasing from front to back, in a longitudinal orientation along said board, and said seat portion has a slope from back to front, and an overall height, when mounted on said board, of between 10 and 18 inches and an overall width of 6 to 8 inches and a centrally located forward cup holder inset into said lower base portion.

10. A method of riding an aquatic board, comprising:

mounting a saddle, including a seat and base portion, to an upper surface of board using a strap attached to said base portion, wherein, said seat portion and base portion form a tapered shape increasing from front to back, in a longitudinal orientation along said board, and said seat portion has a slope from back to front, and an overall height, when mounted on said board, of between 10 and 18 inches and an overall width of 6 to 8 inches and a centrally located forward cup holder inset into said lower base portion;

placing said board onto a water surface;

alighting onto said board and placing respective feet of a user on either side of and adjacent said saddle;

retaining balance of said user via squeezing said feet on and against either side of said saddle on said board; and, riding on said water surface using said board.

* * * * *